US005229736A

United States Patent [19]

Adams et al.

[11] Patent Number: 5,229,736

[45] Date of Patent: Jul. 20, 1993

[54] WAVEGUIDE POLARIZATION COUPLING

[76] Inventors: Douglas W. Adams, 30 Outrigger Ct., Long Beach, Calif. 90803; Carol Kirksey, 13450 Crocker Ct., Fontana, Calif. 92336

[21] Appl. No.: 817,623

[22] Filed: Jan. 7, 1992

[51] Int. Cl.[5] ..... H01P 1/16; H01Q 13/00

[52] U.S. Cl. ..... 333/21 A; 343/786

[58] Field of Search ..... 333/21 A, 21 R, 26, 333/33, 34, 254, 256, 257, 261, 230, 259; 343/786, 186, 756, 772, 787, 840

[56] References Cited

U.S. PATENT DOCUMENTS 4,528,528 7/1985 Augustin ..... 333/21 A
4,755,828 7/1988 Grim ..... 333/21 A X
4,758,841 7/1988 Grim ..... 333/21 A X
4,873,534 10/1989 Wohlleben et al. ..... 343/786
4,910,527 3/1990 Dushane et al. ..... 343/786

FOREIGN PATENT DOCUMENTS 59-196608 11/1984 Japan .

*Primary Examiner*—Robert J. Pascal
*Assistant Examiner*—Ali Neyzari
*Attorney, Agent, or Firm*—Lawrence S. Cohen

[57] ABSTRACT

A waveguide and a scaler ring assembly in which the waveguide has external threads and the scaler ring has internal threads for threaded mating engagement so that the position of the waveguide can be easily selected, and is maintained in a secure, close-fitted relationship. The scaler ring has means for attaching to an antenna dish.

2 Claims, 2 Drawing Sheets

WAVEGUIDE POLARIZATION COUPLING

BACKGROUND OF THE INVENTION

This invention relates to waveguide coupling devices for high frequency waveguides, such as used for microwaves, and particularly to a waveguide coupling which rotates the plane of polarization of the waves transmitted through the waveguide.

Many different arrangements have been used to rotate the plane of polarization of a transmitted high frequency wave. For example, couplings have been used which have a stack of similar elements, each with a slot corresponding to the waveguide cross section which are successively stepped to effect rotation. It has been necessary to use substantial gearing and interconnecting mechanisms in such an arrangement for rotating the plane of polarization in constant even increments through the successive slots in these devices. The coupling is operated by an external motor or other actuating means which is bulky, and the devices are generally limited to noncontinuous rotations.

Waveguides of this type frequently employ a scaler ring which helps direct the incoming signal into the waveguide. The scaler ring is also used as a mount for mounting the entire structure correctly and securely relative to the dish.

In the past scaler rings and waveguides have been attached together by means of set screws or by use of a split ring arrangement. These mounting means have the disadvantages that they are inaccurate, insecure and difficult to adjust, and are relatively expensive.

A device similar to the waveguide disclosed herein is shown in Augustin, U.S. Pat. No. 4,528,528.

Another type of device which is of interest with respect to rotation of the plane of polarization is disclosed in the patent to Moore U.S. Pat. No. 3,708,767 which shows a rotary adjusting means for polarization orientation. The Heeren U.S. Pat. No. 3,622,921 also discloses a polarization rotator which uses a dielectric disc powered by an external motor. The patent to Hudspeth U.S. Pat. No. 4,060,781 uses a stepping motor system for adjusting rotational angle of a quarter wave plate.

However, none of these devices discloses a scaler ring threadedly mounted on the circular waveguide.

SUMMARY OF THE INVENTION

This invention provides a waveguide polarization coupling assembly in which fine, close and secure, adjustable fit of a scaler ring onto the circular waveguide by threadedly mounting of the scaler ring onto the circular waveguide provides accurate and secure mounting of the scaler ring and therefore provides high accuracy directing of incoming waves into the circular waveguide and precise and secure mounting of the assembly onto a dish.

DESCRIPTION OF THE INVENTION

Figure 1:
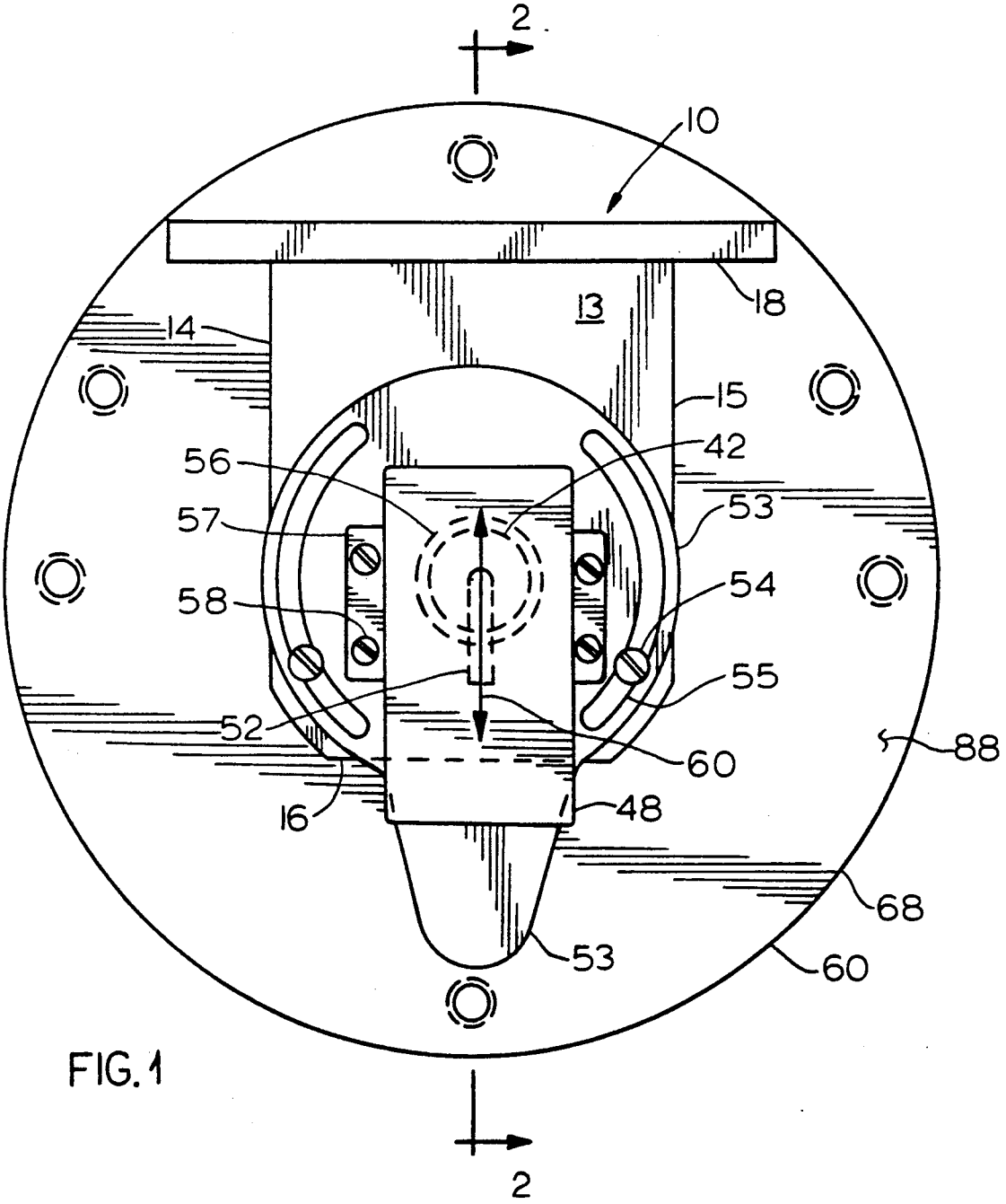
FIG. 1 is a rear view of the scaler ring and waveguide assembly.

Referring to the Figures the rectangular waveguide generally indicated at 10 has front and rear faces 12 and 13 respectively, and side faces 14 and 15. The bottom 16 closes the rectangular waveguide, and coupling flange 18 at the top of the rectangular waveguide permits it to be coupled to matching waveguide sections.

The separator wall section 20, is disposed adjacent the rectangular waveguide bottom 16, and provides for transition of the high frequency waves. It has a smaller annular coupling opening 22 and a larger annular coupling opening 24 extending therethrough. Immediately opposite and in line with the annular coupling opening 22 of the separator section 20 is a coupling rear wall opening 26 disposed within the rear wall 13 of the rectangular waveguide.

A circular waveguide, generally indicated at 30, is attached to the lower end of the rectangular waveguide 10 adjacent the bottom 16. It has an internal circular surface 32. The far end of the circular waveguide element terminates at 38. The circular waveguide 30 has a cylindrical external surface 39 along a portion of which are external threads 40. The rectangular waveguide 10 and the circular waveguide 30 are preferably fabricated as a single piece such as by casting. The coupling probe assembly, generally indicated at 41, consists of a cylindrical dielectric coupling support section 42 which has an internal axial probe support bore 44. The cylindrical section extends through the annular opening 26 in the rear face 13 and is seated in the annular opening 22 in the front face 12 by means of shoulder and bearing surface formed by a reduced diameter portion 46. The coupling support section 42 continues into and then engages a drive element in a control motor assembly 48. The means for this engagement is not shown in detail as any convenient means can be adapted so long as it can disengage when the control motor assembly 48 is removed and re-engaged when it is attached. For example, a diametrical slot in the end of the coupling support section 42 may engage a mating diametrical bar attached to the motor drive.

Figure 2:
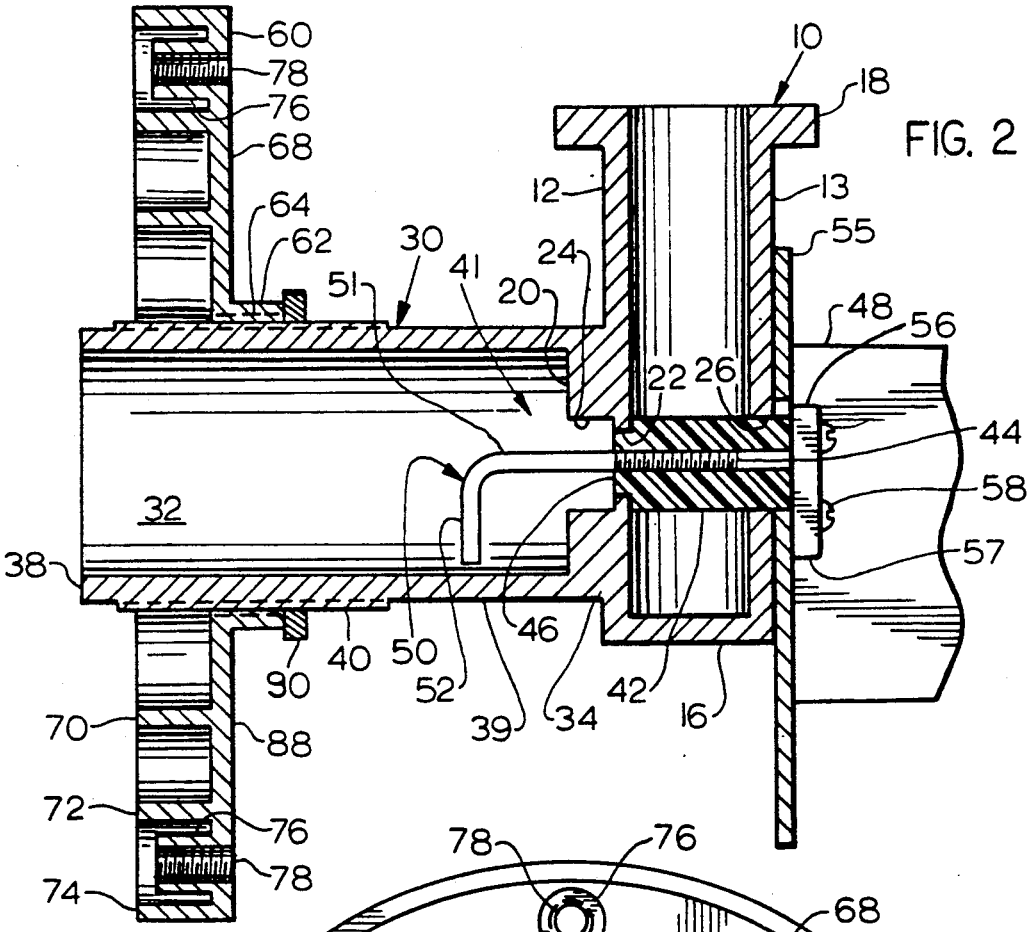
FIG. 2 is a sectional view taken along 2—2 of FIG. 1 showing the scaler ring mounted on a waveguide.
Figure 3:
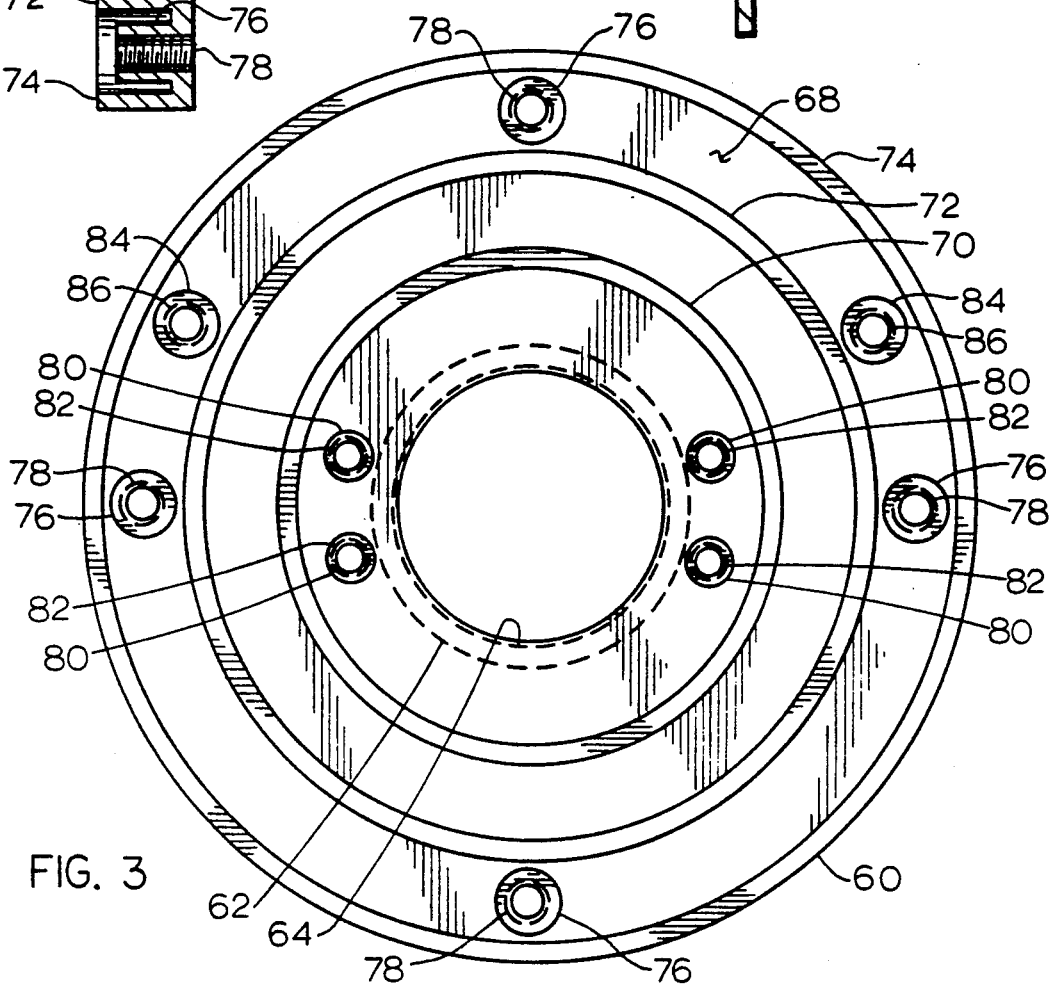
FIG. 3 is a front view of the scaler ring.

An L-shaped metallic probe element 50 having an elongated support and conductor section 51 is firmly inserted within the probe support bore 44 of the probe assembly of the dielectric section 42. This insertion may be press-fit; or the probe element 50 may be threaded as shown in FIG. 2 such that it self-threads into the plastic material of the coupling support section 42. The short leg 52 extends into the circular waveguide and is disposed in a plane perpendicular to the axis of the circular waveguide. The metallic probe can be rotated within the bore 44 to provide any desired angular rotation, and in addition, the distance of the leg 52 from the separator section 20 can be varied by pressing or threading the probe 50 in the bore 44. The end of the elongated support section 51 does not extend through the rear wall 13 of the rectangular waveguide, but is positioned short of the rear wall 13.

An adjusting plate 53 is attached to the rear wall 13 by means of screws 54 which screw into threaded holes in the rear wall 13. The screws pass through slots 55 in the adjusting plate 53 so that when the screws 54 are loosened the adjusting plate can rotate. A central hole 56 is in the plate 53 which allows the coupling support section 42 to pass through into motor drive assembly 48. The motor drive assembly 48 has flanges 57 which have holes which can line up with threaded holes in the adjusting plate 53 and allow the motor drive assembly 48 to be mounted onto the plate 53 by screws 58. The length of the slots 55 will allow for 45° of rotation in either direction. Therefore, the entire assembly of the motor drive assembly 48 and the coupling probe assembly 40 can be rotated with rotation of the adjusting plate 53.

It should be noted that the probe assembly central section 42 within the rectangular waveguide does not affect the impedance characteristics of the waveguide.

At the front of the circular wave guide 30 is a large diameter flange 60 also known as a scaler ring.

The scaler ring 60 has a hub 62 which has internal threads 64. A plate 68 which is disc shaped is attached to the hub 62. Extending forwardly from the rear plate 68 are concentric scaler rings 70, 72, and 74. Also extending forwardly from the disc are a series of bosses having threaded holes grouped for mounting the waveguide on antenna dishes of various designs. Therefore bosses 76 have threaded holes 78 for mounting on one design. Bosses 80 have threaded holes 82 for mounting on another design. Bosses 84 have threaded holes 86 for mounting on yet another design. All the threaded holes are perpendicular to the plate 68, in particular to its rear face 88.

The scaler ring and the waveguide are joined by mating the threads 40 of the circular waveguide 30 and threads 64 of the scaler ring. This threaded engagement allows for fine placement of the scaler ring 60 longitudinally along the circular waveguide 30 and also maintains a firm perpendicular relationship of the disc 68 to the longitudinal axis of the circular waveguide 30 with little or no wobble or looseness. A threaded locking ring 90 is on the threads 40, and can be tightened against the hub 62 when the proper position of the waveguide 10 on the scaler ring 60 is determined. Therefore when the scaler ring 60 is mounted on a dish the correct position of the waveguide can be easily achieved, with the waveguide then firmly fixed in place, being accurately set longitudinally of the axis of the circular waveguide 30 and with good axial alignment with incoming signal along the signal axis of the dish and absent any tendency to come loose or any wobble.

The following description generally speaks in the receiving mode of antenna operation since the primary application of this type of antenna is for satellite signal reception; however, due to the reciprocity theory of antenna function, the antenna is equally available as a receiving or transmitting antenna.

The polarization waveguide assembly receives the high frequency waves, such as microwaves, through the circular waveguide 30 and they are transmitted through the separator section 20 and carried out of the waveguide coupling assembly 39 and into the rectangular waveguide element 10. The circular waveguide element 30 is oriented perpendicular to the rectangular waveguide element 10. The probe assembly 41 with its dielectric coupling support section 42 provides for polarization of the received waves in the circular waveguide output element by means of the orientation of the short leg 52. The metallic coupling probe 50 acts as a loop coupling in the circular waveguide 30 and as a capacitive coupling in the rectangular waveguide 10.

The L-shaped metallic coupling probe 50 can be rotated within the dielectric coupling support section to provide for desired angular orientation to receive either rectangular horizontally polarized waves. This rotation is possible by rotating it inside the dielectric support section 42, which is useful for factory orientation of the probe 50 with the motor drive assembly 48. It can also be adjusted, along with the motor drive assembly, for proper positioning during installation on a dish.

The dielectric coupling support section 42 has a circular section within the waveguides, with its central axis mounted along the axis of the circular waveguide 30. It is symmetrically mounted with respect to the rectangular waveguide element 10. Inasmuch as the coupling support 42 has a mounting at the central portion of the rectangular waveguide 10, it has an axis of symmetry about the probe so that rotation of the probe will not bring about a change in configuration of the rectangular waveguide element 10. Thus it is impedance matched and is independent of orientation of the probe 50 in that waveguide and is impedance matched for all positions.

With regard to rotation of polarization within the circular waveguide element 30, the motor assembly 48 can be controlled in precise ninety degree steps. Polarization rate is limited only by the speed of the motor, and can be changed unidirectionally or bi-directionally according to the motor characteristics. A high gear ratio motor permits instantaneous stopping to prevent over-travel of the polarization orientation probe.

The scaler ring 60 permits the setting of orientation of the entire assembly with respect to the unit to which the waveguide coupling assembly is to be connected such as a microwave receiving dish. However, it is possible to also accomplish this, as mentioned previously, by movement of the L-shaped metallic coupling probe 50 within the dielectric coupling support. When the apparatus is to be installed on a dish, it is normal procedure to orient the short leg 52 in a vertical plane. By appropriate construction and factory adjustment, the motor assembly 48 and the short leg 52 are set to provide a fixed relative position. Therefore, a guide arrow 60 is placed on the back of the motor assembly 48 to guide the installer. This designates that the motor is in the vertical polarization portion, ready to be connected to the satellite receiving unit which operates the motor between vertical and horizontal portions. The probe has been aligned in the factory to the vertical orientation of the motor. Normal field installation procedure is to set the short leg 52 in the vertical plane. With the guide arrow 60 set vertically, the short leg 52 will also be vertical.

The assembly is mounted on a dish by means of the exemplary mounting hole sets 76, 80 or 84, which will mate to the dish mounting structure. However, the mounting structure of many dishes will not achieve exact orientation of the short leg 52 in a vertical plane. Therefore, a precise adjustment can be made through use of the adjusting plate 53. This is done by loosening the screws 54 and setting the guide arrow 60 to precise vertical. Also, this can be done electrically by observing a received signal for maximum polarization strength. Then the screws 54 are tightened.

The application of voltage to the motor causes probe support assembly 40 to rotate, thus rotating the coupling 50 and the polarization of the high frequency wave electric vector.

As pointed out above, the threaded engagement of internal surface of the hub 62 to the external surface of the circular waveguide 30 allows fine longitudinal adjustment as well as accurate axial alignment of the waveguide to the dish for strongest signal reception.

Therefore this invention provides the threaded circular waveguide and the threaded scaler ring which match up so that once the scaler ring is mounted to the dish, the focal depth can be easily adjusted by simply tuning the circular waveguide in or out to the proper depth. Therefore there are the following operational features:

The ability to accurately adjust the focal depth.

The ability to properly position the probe and the vertical axis by aligning the polar axis arrow on the servo motor and the vertical axis of the dish when turning the circular waveguide in and out.

Placing the circular waveguide in a position perfectly perpendicular to the scaler ring, which insures that the circular waveguide is looking directly and accurately into the boresight of the dish.

While the invention has been described in connection with different embodiments thereof, it will be understood that it is capable of further modification, and this application is intended to cover any variations, uses, or adaptation of the invention following, in general, the principles of the invention and including such departures from the present disclosure as come within known or customary practice in the art to which the invention pertains, and as may be applied to the essential features hereinbefore set forth and fall within the scope of the invention or the limits of the appended claims.

We claim:

1. A waveguide alignment and mounting assembly comprising:

(a) a first waveguide element for receiving signals from a dish and having external threads along an outside cylindrical surface;

(b) a disc having a central circular opening defining an internal circular surface, said internal circular surface being internally threaded for mating engagement with the threads on the external cylindrical surface of the first waveguide and said disc having a means for mounting on an antenna dish whereby the waveguide may be set to a selected position along it axis relative to the dish and is held securely in axial alignment by said threaded engagement.

2. The assembly of claim 1 further comprising scaler rings on said disc.

* * * * *